US006536191B1

(12) United States Patent
Ruggiero

(10) Patent No.: US 6,536,191 B1
(45) Date of Patent: Mar. 25, 2003

(54) METHOD AND APPARATUS FOR HIGH SPEED ENVELOPE TRAYING

(75) Inventor: Ralph Ruggiero, Green Valley, AZ (US)

(73) Assignee: Bell & Howell Mail and Messaging Technologies Company, Durham, NC (US)

( * ) Notice: Subject to any disclaimer, the term of this patent is extended or adjusted under 35 U.S.C. 154(b) by 0 days.

(21) Appl. No.: 09/360,817

(22) Filed: Jul. 26, 1999

Related U.S. Application Data

(60) Provisional application No. 60/141,339, filed on Jun. 28, 1999.

(51) Int. Cl.[7] ..... B65B 3/24

(52) U.S. Cl. ..... 53/475; 53/250; 271/207

(58) Field of Search ..... 53/475, 473, 443, 53/235, 244, 245, 250, 535; 271/207, 276; 198/460.3

(56) References Cited

U.S. PATENT DOCUMENTS 3,674,143 A * 7/1972 Hunter et al.
3,782,541 A 1/1974 Wood
3,790,158 A * 2/1974 Summers et al.
3,943,681 A 3/1976 Preisig
4,055,256 A 10/1977 Hagedorn
4,161,095 A 7/1979 Buday
4,433,526 A 2/1984 Nord
4,482,059 A 11/1984 Horii et al.
4,524,564 A 6/1985 Groom et al.
4,676,050 A 6/1987 Odenthal
4,800,703 A 1/1989 Goodman
4,879,862 A 11/1989 Nolte et al.
4,902,184 A 2/1990 Fritz
5,069,598 A * 12/1991 Kleinhen et al.
5,117,614 A 6/1992 Johnsen
5,330,174 A * 7/1994 Ricciardi
5,347,790 A 9/1994 Romanenko et al.
5,368,287 A 11/1994 Belec et al.
5,411,250 A 5/1995 Belec et al.
5,419,440 A 5/1995 Picoult
5,419,457 A * 5/1995 Ross et al.
5,449,159 A 9/1995 Belec et al.
5,503,388 A * 4/1996 Guenther et al.
5,588,285 A 12/1996 Odenthal
5,675,959 A * 10/1997 Hamma et al.
5,803,704 A * 9/1998 Lazzarotti
5,906,468 A * 5/1999 Vander Syde et al.
5,908,116 A * 6/1999 Levaro et al.

* cited by examiner

*Primary Examiner*—Eugene Kim
(74) *Attorney, Agent, or Firm*—McDermott, Will & Emery

(57) ABSTRACT

A method and apparatus for high speed traying of mail pieces includes a tray filling head assembly, a tray fill conveyor assembly, and a tray feed assembly. A continuous stream of mail pieces are fed into the tray fill head assembly, which controllably moves the mail pieces one at a time into a postal carrier tray. The postal carrier trays are selectively staged for filling and automatically ejected when filled by the tray fill conveyor assembly. The tray feed assembly feeds the trays to the tray fill conveyor assembly. When a filled tray is being exited and an empty tray is being staged for filling, the tray fill head assembly buffers the mail pieces so that the continuous stream of mail pieces is not interrupted.

22 Claims, 4 Drawing Sheets

METHOD AND APPARATUS FOR HIGH SPEED ENVELOPE TRAYING

This application claims the benefit of provisional application No. 60/141,339, filed Jun. 28, 1999.

The present invention relates to a method and apparatus for the high speed traying of envelopes, and in particular, a method and apparatus for high speed delivery of envelopes directly into a postal carrier tray; specifically a method and apparatus for moving an empty postal tray into an envelope receiving position, rapidly delivering a continuous stream of envelopes into the postal tray until full, automatically removing the tray when full, and moving a subsequent empty postal tray into the envelope receiving position without interrupting the continuous stream of envelopes.

BACKGROUND OF THE INVENTION

Many businesses and postal services utilize high speed mail processing machines to rapidly produce and/or process completed mail pieces, such as stuffed envelopes. Completed mail pieces from such machines must then ultimately be placed into a postal carrier trays. Typically, these envelopes are accumulated in stacks, and then the stack is delivered to the postal tray.

A known device for the automatic traying of a stack of envelopes is disclosed in U.S. Pat. No. 5,347,790 entitled "Automatic Traying and Automatic Sweeping Device for Letter Mail," issued to Romanenko et al. on Sep. 20, 1994. This device accumulated envelopes in an accumulating chamber above a postal tray, and then drops the accumulated stack through a trap door arrangement. However, such a device is relatively cumbersome and time consuming. Further, the dropping process of such a device is loud and tends to disrupt the stack, resulting in improper traying and/or the lose of mail pieces from time to time.

Accordingly, there is a need for a method and apparatus to load mail pieces directly into a postal tray in a smooth, efficient and quiet operation. The present invention fulfills such a need.

BRIEF SUMMARY OF THE INVENTION

The present invention comprises a method and apparatus for high speed delivery of envelopes directly into a postal carrier tray. Specifically, the present invention comprises a tray fill head assembly which receives a continuous stream of envelopes and rapidly delivers the same into a postal tray; a tray fill conveyor assembly which moves empty postal trays into an envelope receiving position below the tray fill head assembly and automatically removes the trays when full, replacing the full tray with an empty tray without interrupting the continuous stream of envelopes; and a tray feed assembly which holds a plurality of postal trays and selectively delivers the trays one at a time to the tray fill conveyor assembly.

Accordingly, it is the principle object of the present invention to provide a method and apparatus for the high speed traying of mail pieces such as envelopes.

It is a further object of the invention to provide a method and apparatus for high speed delivery of envelopes directly into a postal carrier tray.

It is also an object of the invention to provide a method and apparatus for moving an empty postal tray into an envelope receiving position, rapidly delivering a continuous stream of envelopes into the postal tray until full, automatically removing the tray when full, and moving a subsequent empty postal tray into the envelope receiving position without interrupting the continuous stream of envelopes.

It is an additional object of the present invention to provide a tray fill head assembly for receiving mail pieces and delivering them to a postal tray in a smooth, efficient and quiet manner.

It is another object of the present invention to provide a tray fill conveyor assembly for repeatedly positioning empty postal trays under a tray fill head assembly, and removing the same once full without interrupting the stream of mail pieces.

It is a still further object of the present invention to provide a tray feed assembly for selectively feeding a plurality of postal trays one at a time to a tray fill conveyor assembly.

Numerous other advantages and features of the invention will become readily apparent from the detailed description of the preferred embodiment of the invention, from the claims, and from the accompanying drawings in which like numerals are employed to designate like parts throughout the same.

BRIEF DESCRIPTION OF THE DRAWINGS

A fuller understanding of the foregoing may be had by reference to the accompanying drawings wherein.

DETAILED DESCRIPTION OF THE PREFERRED EMBODIMENT OF THE PRESENT INVENTION

Figure 1:
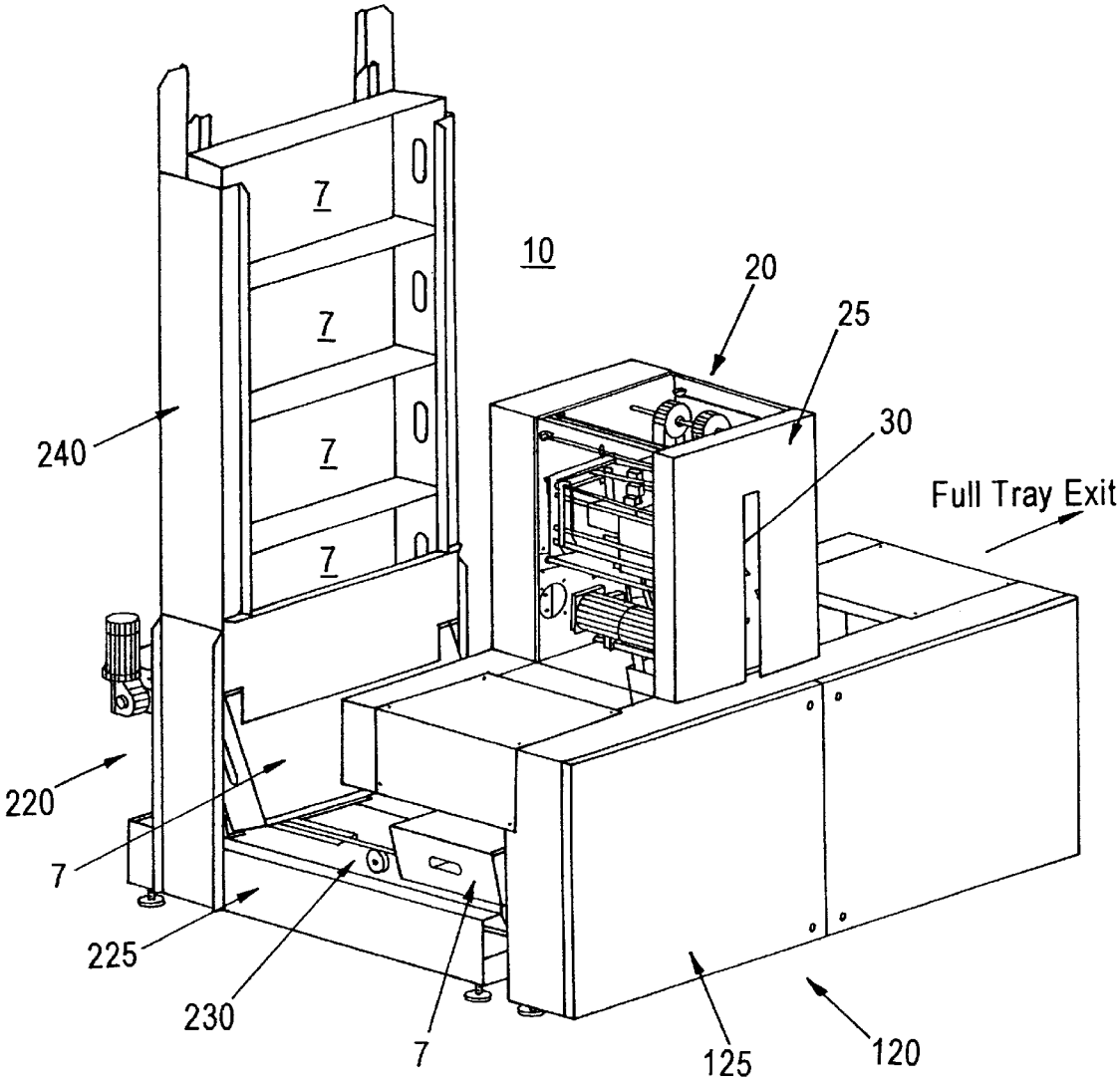
FIG. 1 is a perspective view of the present invention.

While the invention is susceptible of embodiment in many different forms, there is shown in the drawings and will be described herein in detail a preferred embodiment of the invention. It should be understood however that the present disclosure is to be considered an exemplification of the principles of the invention and is not intended to limit the spirit and scope of the invention and/or claims of the embodiment illustrated.

FIG. 1 illustrates the present invention 10 comprising a tray fill head assembly 20 in a housing 25. Tray fill head assembly 20 is mounted above a tray fill conveyor assembly 120 having housing 125. Positioned adjacent to the tray fill conveyor assembly 120 is a tray feed assembly 220 having housing 225. The tray feed assembly 220 holds a supply of postal trays 7 in a tray chute 240, which feeds the trays 7 one at a time to the tray fill conveyor assembly 120 via a tray feed conveyor 230. As will be described in more detail below, trays 7 are fed into the tray fill conveyor assembly 120 by the tray feed assembly 220. The tray fill conveyor assembly 120 moves the tray 7 first into position under the tray fill head assembly 20 for filling, and then when full, out of the present invention. The tray fill head assembly receives a continuous stream of envelopes at high speeds through an envelope entry guide 30 and moves the envelopes into the trays 7.

Figure 2:
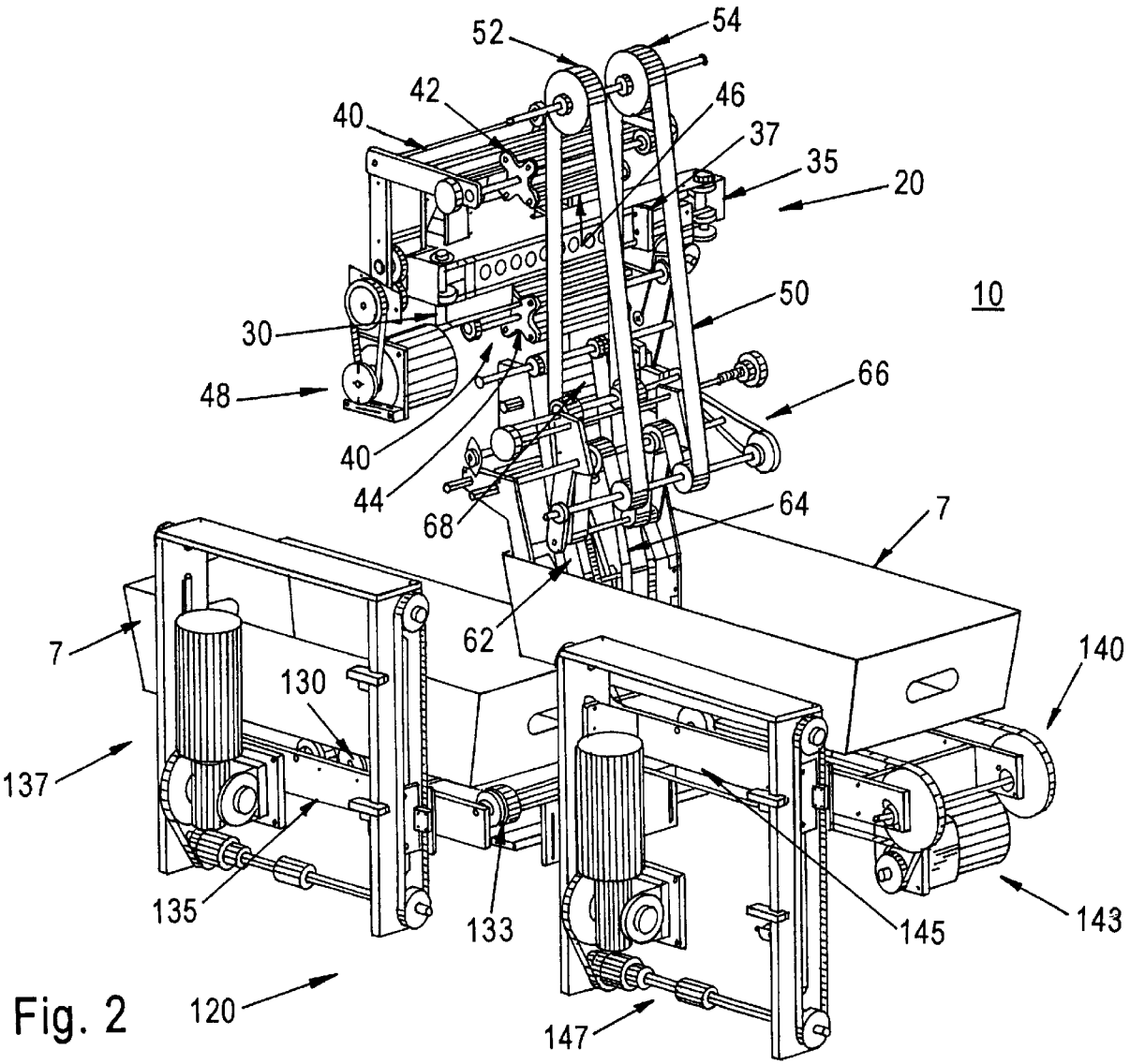
FIG. 2 is a perspective view of the tray fill head assembly and the tray fill conveyor assembly of the present invention.

FIG. 2 illustrates a perspective view of the tray fill head assembly 20 and the tray fill conveyor assembly 120. As can be seen, an envelope feed mechanism 35 is positioned in the tray fill head assembly 20 at the envelope entry guide 30. Mechanism 35 is used to feed the envelopes into the head assembly 20 in position to be trayed. While it is contemplated that any suitable feed mechanism can be used to feed the envelopes into the head assembly 20, feed mechanism 35 preferably takes the form of a vacuum conveyor in which envelopes are held against drive belts by a vacuum force, and the drive belts move the envelopes into position in a rotating roller assembly 40. An envelope stop 37 defines the limit of the envelope movement into the tray fill head assembly, and assures the envelopes are properly positioned in the rotating roller assembly 40.

Figure 3:
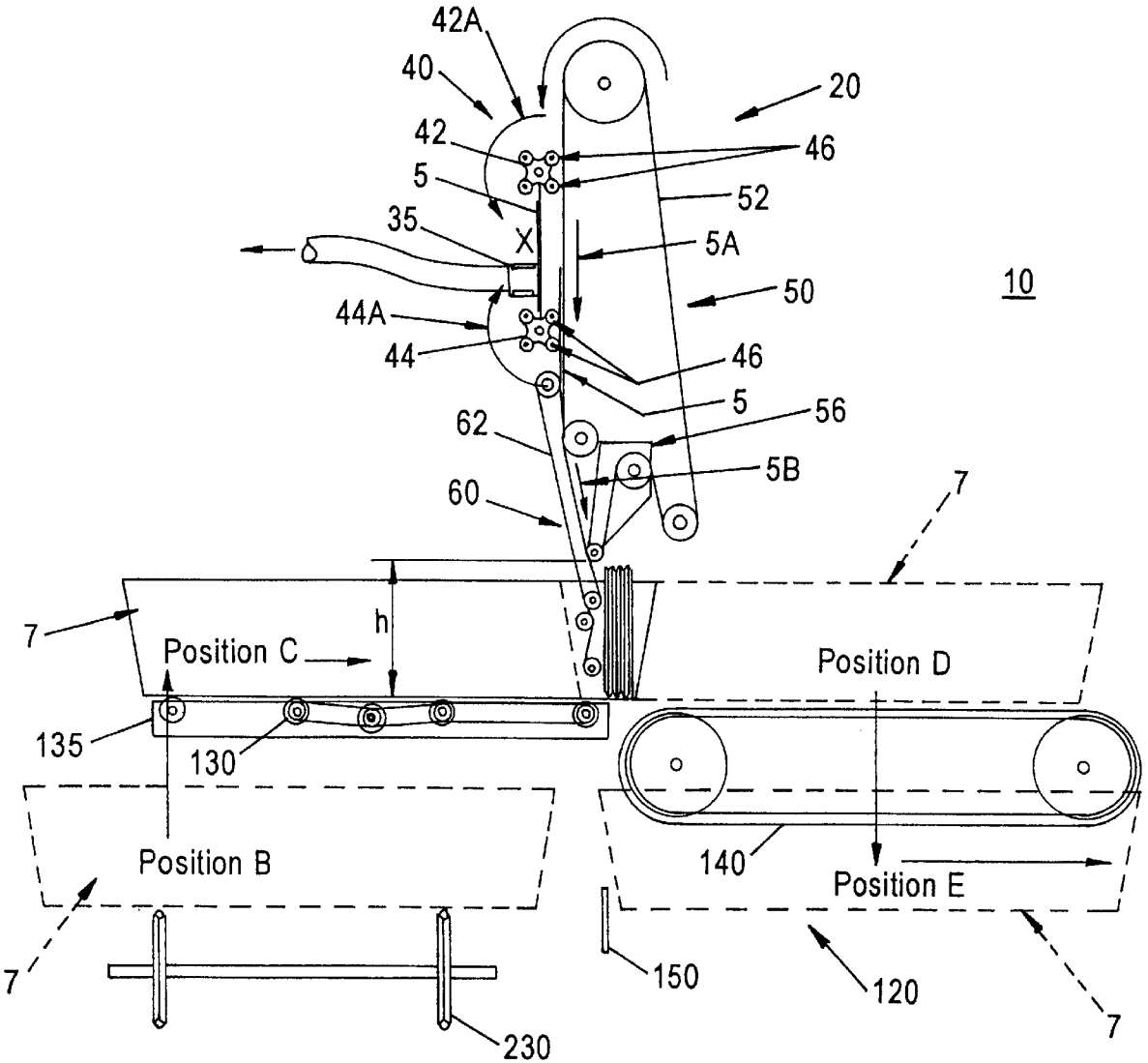
FIG. 3 is a front schematic view of the present invention as seen in the direction of arrow F3 in FIG. 1.

Rotating roller assembly 40 comprises an upper roller unit 42 and a lower roller unit 44. Each roller unit 42 and 44 includes a plurality of idler rollers 46. As shown, each unit contains four rollers 46, however more or less rollers are contemplated. Roller units 42 and 44 are mounted for opposite rotation relative to each other, and are driven by suitable drive means 48 comprising any suitable combination of gears, pulleys, belts and a motor or similar drive components. Thus, after an envelope 5 is feed in between the roller units 42 and 44, as seen in FIG. 3, as the roller units 42 and 44 rotate, one of the rollers 46 on each unit 42 and 44 contacts the envelope and propels the envelope towards an envelope drive belt assembly 50.

Envelope drive belt assembly 50 comprises, as illustrated, two generally flat drive belts 52 and 54. It should be understood however that one wider drive belt or more than two drive belts could be used. Drive belts 52 and 54 are driven by suitable drive means 66 comprising any suitable combination of gears, pulleys, belts and a motor or similar drive components. Preferably, drive means 66 includes a means 68 for selectively buffering envelopes in the form of is a stepper motor to allow for both continuous and selected stepped or intermittent movement of the drive belts to effect buffering of envelopes in the tray fill head assembly 20, as will be described in more detail below.

When the envelope contacts the drive belts 52 and 54, they become pinched between the belts and the idler rollers 46 which are propelling the envelope toward the drive belts. Idler rollers 46 are free to rotate about their mounting shafts. Thus, upon contacting the drive belts 52 and 54, the envelope is driven down towards the tray 7 positioned below the fill head assembly 20.

When the envelope progresses past the roller 46 on the lower roller unit 44, the envelope then becomes pinched between the drive belt assembly 50 and an envelope nip belt assembly 60. Envelope nip belt assembly 60 comprises, as illustrated, two generally flat nip belts 62 and 64. It should be understood however that one wider nip belt or more than two nip belts could be used. Nip belts 62 and 64 are driven by drive means 66, and extend into tray 7 when the tray is being filled. Thus, the drive belts 52 and 54 and the nip belts 62 and 64 cooperate to drive the envelope into the tray 7, which has been positioned to receive envelopes by the tray fill conveyor assembly 120.

As further can be seen in FIG. 2, tray fill conveyor assembly 120 comprises a tray staging conveyor assembly 130 and a tray exit conveyor assembly 140. Each conveyor assembly 130 and 140 is driven by a drive means 133 and 143, respectively, to propel a tray 7 therealong. Additionally, each conveyor assembly 130 and 140 is suitably mounted to an elevator assembly 135 and 145 respectively. Each elevator assembly 135 and 145 is driven by a drive means 137 and 147 respectively, to selectively raise and lower the conveyor assemblies 130 and 140.

Referring now to FIG. 3, an empty postal tray 7 is moved onto the tray staging conveyor assembly 130 by tray feed conveyor 230 and into tray position B (shown in phantom). Tray staging conveyor assembly 130 moves the tray forward until the leading edge of the tray is positioned under the tray fill head assembly 20. A tray stop 150 and/or a sensor or other suitable means can be used determine when the leading edge of the tray 7 is under the tray fill head assembly 20. Elevator assembly 135 then lifts the tray up to tray position C. As can be seen, the lower rollers of the envelope nip belt assembly 60 are positioned inside of tray 7. Further, the lower and center drive belt rollers 56 are adjustable, and are set at a level just above the height h of the envelopes 5, thus allowing for traying of different sized envelopes. Similarly, the rotating roller assembly 40 is likewise adjustable to accommodate various sized envelopes.

When the tray 7 is in position C, the tray head assembly begins to deliver envelopes 5 into the tray 7. Envelope feed mechanism 35 receives envelopes in an X direction, and positions an envelope 5 between the upper roller unit 42 and the lower roller unit 44 as shown. The roller units 42 and 44 rotate in opposite directions as indicated by arrows 42A and 44A respectively. As the roller units 42 and 44 rotate, they propel the envelope 5 in a Y direction into the drive belts 52 and 54 (see FIGS. 2 and 4), which propels the envelop in a Z direction towards the nip belts 62 and 64 (see FIGS. 2 and 4) in the direction of arrow 5A. The drive belts and nip belts then continue to propel the envelope 5 in the direction of arrow 5B directly into the tray 7.

As can be seen in FIG. 3, the lower nip belt rollers are positioned substantially under the lowest drive belt roller so that the envelopes, once positioned in the tray, remain out of the way of the subsequent incoming envelopes. As the envelopes fill the tray 7, they push against the end of the tray, moving the tray 7 on rollers toward and onto tray exit conveyor assembly 140. A minimum back pressure is maintained by an adjustable spring pressure friction clamp that pushes on the side of two of the rollers to create drag between the conveyor rollers and the tray. When the tray 7 is approximately half full of envelopes 5, the leading edge of the tray 7 reaches a sensor which triggers the elevator drive means 137 to lower the elevator assembly 135. Tray staging conveyor assembly 130 is thus in position to receive another empty tray from tray feed assembly 230.

Tray 7, now supported on tray exit conveyor assembly 140, continues to be filled, and self-propelled by the envelopes 5, until the leading edge of the tray 7 reaches another sensor when the tray is full (tray position D). The elevator drive means 147 is then triggered to lower the elevator assembly 145. Tray exit conveyor assembly 140, and the full tray 7, are thus lowered away from the nip belt rollers (tray position E) and is free to be removed from the present invention. Tray exit conveyor drive means 143 are activated at this time to move the tray out of the tray fill conveyor assembly 120.

Figure 4:
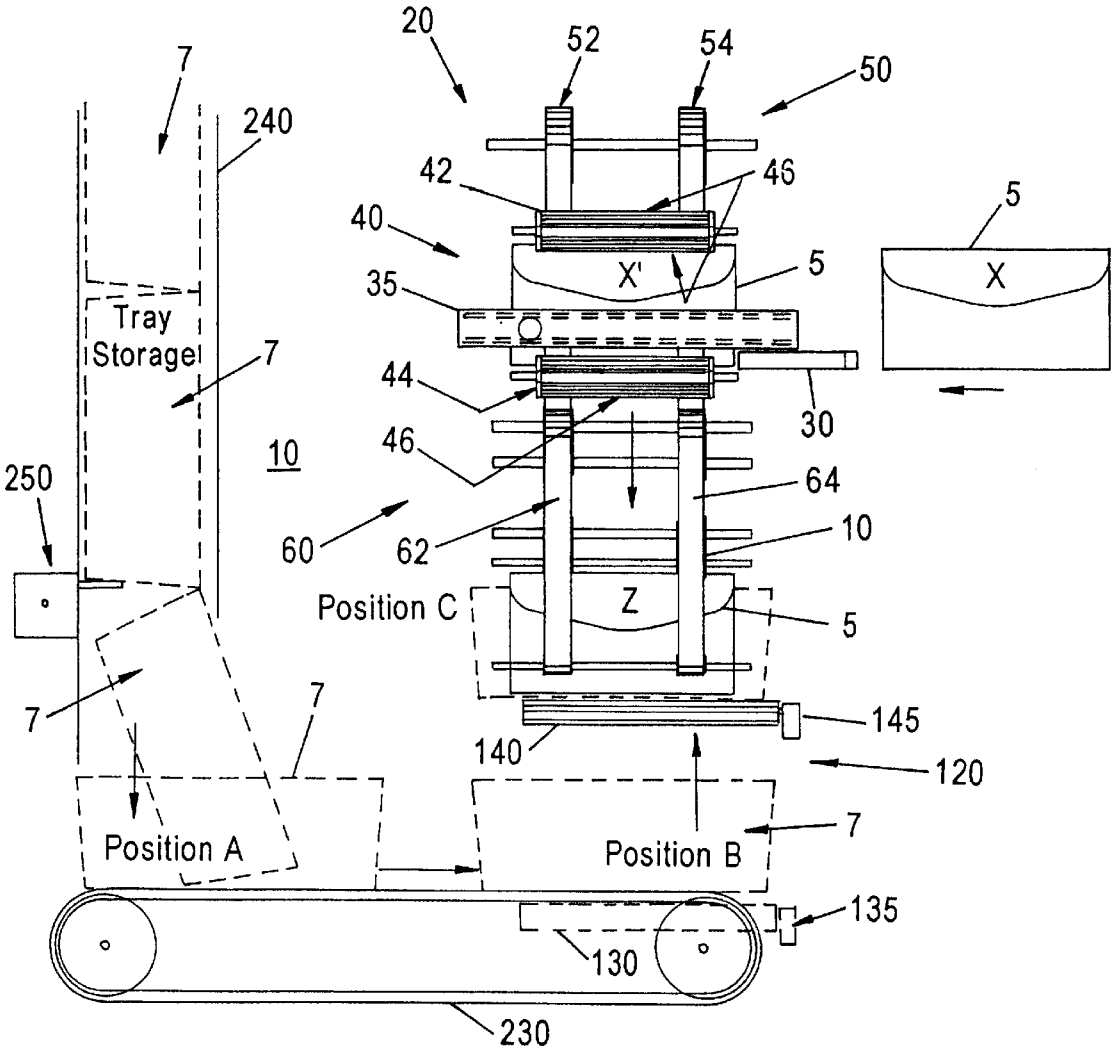
FIG. 4 is a side schematic view of the present invention as seen in the direction of arrow F4 in FIG. 1.

Referring now to FIG. 4, trays 7 are stored in tray chute 240 of tray feed assembly 220, and are selectively delivered to tray feed conveyor 230. Initially, all trays 7 are held vertically in the chute 240. Various sized trays can be accommodated, and it is contemplated that any number of trays can be stored by lengthening the size of the chute or by attaching additional chutes. To feed a tray 7, the feed conveyor 230 is advanced a small distance. This causes the bottom tray in the chute 240 to tilt as shown in phantom. When tilted, a space is opened between the lowest tray and the adjacent tray. A gate mechanism 250, shown in the form of retractable pins, although any suitable gate means are contemplated, is then activated to prevent the adjacent tray from falling to the feed conveyor 230. Once gate 250 is in place, feed conveyor 230 advances, at which time the lowest tray 7 moves to its horizontal position (tray position A), and is delivered to tray staging conveyor assembly 130 (tray position B).

As described above, elevator 135 lifts the tray staging conveyor 130 and tray 7 from position B to position C to be filled. Once half filled, tray 7 is supported on tray exit conveyor assembly 140 with elevator 145 in its upper position, and elevator 135 and tray staging conveyor assembly 130 returns to its lower position. The upper and lower limits of the movement of the elevators are defined by any suitable means, such as sensors.

There is a very slight delay of approximately one and one half seconds for a full tray to be lowered and moved from the nip rollers, and for an empty tray to be staged in tray position C. While the stream of envelopes can temporarily be halted for this time, this is undesirable since running at very high speeds all day long, such a halt could result in a significant difference in the number of trays being filled over a given period of time than if there was no halt.

Accordingly, the present invention provides for a means for buffering 68, such that the continuous stream of envelopes need not be interrupted. During the exchange of trays, envelopes 5 are buffered inside the tray fill head assembly 20. This is accomplished by controlling drive means 66, such that continuous movement of drive belts 52 and 54 (and nip belts 62 and 64) is discontinued, and instead, drive belts 52 and 54 are stepped or move intermittently. As a result, as envelopes are moved into position between upper and lower roller units 42 and 44 respectively by envelope feed mechanism 35, and are pushed into contact with drive belts 52 and 54 by rollers 46, the envelopes advance downward in incremental steps. Subsequent envelopes moved into contact with belts 52 and 54 partially overlap with the previous envelope. This results in a staggered column of envelopes being buffered in the tray fill head assembly 20. When the new tray is in position, the drive means 66 are switched back to run continuously, and the buffered envelopes are simply driven into the tray and normal operation continues. In this manner, the continuous stream of envelopes is not interrupted, and a greater number of filled trays can be achieved. During the approximately one and one half seconds for the tray change, roughly seven to ten envelopes will be buffered in the tray fill head assembly. A sensor is also provided to sense when an envelope has cleared the drive and nip rollers to assure that an envelope will not be dropped during the tray exchange.

All drive means and sensors are operatively connected to suitable controllers, such as programable logic controllers to synchronize operation of all assemblies of the present invention. As described above, the present invention provides for constant control of each mail piece between the mail processing machine and the postal tray. The present invention will further accommodate and load not only mail pieces of varying widths and heights, but also mail pieces of varying thicknesses.

It should be understood that the embodiments herein described are merely illustrative of the principles of the present invention. Various modifications may be made by those skilled in the art without departing from the spirit or scope of the claims which follow. For example, it is foreseen that the tray fill conveyor assembly could take the form of a single conveyor with a single elevator. When the tray is just about full, the feed assembly could feed an empty tray onto the single conveyor in front of the nip rollers. The elevator could then be lowered and both the empty tray and full tray advanced a short distance. The elevator could then be raised such that the empty tray will be in position C and the full tray would be past the nip rollers and could be exited at the raised level while the empty tray fills. Other modifications or substitutions with equivalent elements are also contemplated.

What is claimed is:

1. An apparatus for positioning mail pieces comprising:

a means for receiving mail pieces on edge and from the side and moving said on edge mail pieces face forward, said means for receiving and moving comprising a rotating roller assembly, said rotating roller assembly including a pair of spaced apart, opposed, rotatable members each having a plurality of idler rollers mounted thereabout and defining envelope edge receiving spaces between said plurality of idler rollers on said rotatable members; and a means for driving said on edge mail pieces in a downward direction, said means for driving cooperating with said means for receiving and moving.

2. The apparatus of claim 1, wherein said means for driving is a drive belt assembly.

3. The apparatus of claim 2, wherein said drive belt assembly comprises at least one drive belt and at least one nip belt.

4. The apparatus of claim 3, wherein said drive belt and said nip belt cooperate to sequentially load said mail pieces into a container.

5. The apparatus of claim 1, further comprising a means for buffering.

6. A method of positioning mail pieces comprising the steps of:

feeding mail pieces on edge and from the side into a rotating roller assembly having a pair of spaced apart, opposed, rotatable members each having a plurality of idler rollers mounted thereabout and defining envelope edge receiving spaces between said plurality of idler rollers on said rotatable members;

advancing said mail pieces face forward, via rotation of said pair of opposed, rotatable members, to a drive belt assembly; and driving said mail pieces into a container.

7. The method of claim 6 further comprising the step of selectively buffering said mail pieces in said drive belt assembly.

8. An apparatus for positioning a mail tray for loading of mail pieces via a tray fill assembly, comprising:

a staging conveyor assembly having a means for advancing said mail tray;

first elevator means for selectively raising and lowering said staging conveyor assembly;

an exit conveyor assembly having a means for advancing said mail tray; and second elevator means for selectively raising and lowering said exit conveyor assembly;

said staging conveyor and said exit conveyor defining a linear conveyor path;

said first elevator means and said second elevator means defining a first horizontal level along said linear conveyor path and a second horizontal level along said linear conveyor path;

wherein said staging conveyor assembly advances said mail tray to a staging position at said first horizontal level, said first elevator means raises said mail tray from said staging position to a fill position for receiving mail pieces at said second horizontal level, said mail tray passing from said staging conveyor assembly to said exit conveyor assembly at said second horizontal level as said mail pieces are received in said mail tray in said fill position, said second elevator means lowers said mail tray from said fill position to an exit position at said first horizontal level, and said exit conveyor assembly advancing said mail tray to exit said apparatus.

9. The apparatus of claim 8, wherein said mail pieces are loaded into said tray on edge.

10. The apparatus of claim 9, wherein said mail pieces when loaded into said tray are supported on edge at one end by a wall of said mail tray and at another end by said tray fill assembly.

11. The apparatus of claim 8, wherein said mail tray is moved from said staging conveyor assembly to said exit conveyor assembly during loading via force from successive mailpieces being loaded.

12. A method of positioning a container for the loading of mail pieces by a loading apparatus comprising the steps of:

advancing an empty container along a conveyor path and under said loading apparatus via a staging conveyor at a first horizontal level;

raising said empty container to said loading apparatus for loading at a second horizontal level via a first elevator means;

passing said container from said staging conveyor to an exit conveyor during loading of said container at said second horizontal level;

lowering a loaded container away from said loading apparatus to said first horizontal level via a second elevator means; and advancing said loaded container to an exit via said exit conveyor.

13. A mail piece loading apparatus for loading mail trays comprising:

a tray fill head assembly;

a tray fill conveyor assembly;

said tray fill conveyor assembly selectively staging a tray in a loading position, wherein a portion of said tray fill head assembly extends into said tray in said loading position; and said tray fill head assembly receiving a continuous stream of mail pieces and sequentially loading said mail pieces directly into said tray on edge, wherein said mail pieces when sequentially loaded into said tray are supported on edge at one end by a wall of said mail tray and at another end by said tray fill head assembly;

wherein said tray fill head assembly comprises a belt drive assembly and a nip belt assembly being configured such that each loaded mail piece remains out of the way of the subsequent mail piece being loaded into the tray.

14. The apparatus of claim 13, further comprising a tray feed assembly, said tray feed assembly selectively supplying trays to said tray fill conveyor assembly.

15. The apparatus of claim 13, wherein said tray fill head assembly further comprises a rotating roller assembly for delivering envelopes into contact with said drive belt assembly, said rotating roller assembly comprising a plurality of idler rollers mounted for orbital rotation about a central axis, each idler roller being rotatable about its own axis of rotation.

16. The apparatus of claim 13, wherein said tray fill conveyor assembly comprises a first conveyor, selectively raised and lowered by a first elevator, and a second conveyor selectively raised and lowered by a second elevator.

17. The apparatus of claim 16, wherein said tray passes from said first conveyor to said second conveyor during loading, such that said first conveyor is free to load a subsequent tray while said second conveyor is removing the loaded tray.

18. A method of loading mail trays comprising the steps of:

staging a tray in a loading position via a tray fill conveyor assembly such that a portion of a tray fill head assembly extends into said tray; and loading a continuous stream of mail pieces directly into said tray on edge via said tray fill head assembly;

supporting said mail pieces on edge at one end by a wall of said mail tray and at another end by said tray fill head assembly; and configuring said tray fill head assembly such that each loaded mail piece remains out of the way of the subsequent mail piece being loaded into the tray.

19. The method of claim 18, further comprising the steps of:

removing a loaded tray; and repeating the steps of staging and loading.

20. The method of claim 19, further comprising the step of:

selectively buffering mail pieces in said tray fill head assembly.

21. The method of claim 18, further comprising the step of:

supplying trays to said tray fill conveyor assembly via a tray feed assembly.

22. An apparatus for loading mail pieces into a mail tray comprising:

a belt drive assembly and a nip belt assembly cooperating to move a mail piece into said mail tray; and a rotating roller assembly for delivering mail pieces into contact with said drive belt assembly;

said rotating roller assembly comprising a pair of roller units each comprised of a plurality of idler rollers mounted for orbital rotation about a central axis, and each idler roller being rotatable about its own axis of rotation;

wherein said pair of roller units receive said mail piece therebetween, and rotate to advance the mail piece into the drive belt assembly, whereupon the mail piece is free to be driven owing to rotation of the idler rollers.

* * * * *